United States Patent [19]

Simpson

[11] Patent Number: 4,901,475

[45] Date of Patent: Feb. 20, 1990

[54] EXTERNALLY MOUNTED LATCH FOR SLIDABLE SASH WINDOW

[75] Inventor: Harold Simpson, Hazel Crest, Ill.

[73] Assignee: Ashland Products Company, Chicago, Ill.

[21] Appl. No.: 225,198

[22] Filed: Jul. 28, 1988

Related U.S. Application Data

[63] Continuation-in-part of Ser. No. 148,035, Jan. 25, 1988, Pat. No. 4,837,975.

[51] Int. Cl.[4] ..... E05D 15/22

[52] U.S. Cl. ..... 49/175; 49/161; 49/449

[58] Field of Search ..... 292/175, 153; 49/161, 49/450, 180, 181, 175, 453, 449, 394, 174, 176

[56] References Cited

U.S. PATENT DOCUMENTS

| | | | |
|---|---|---|---|
| 114,152 | 4/1871 | Judd | 292/175 |
| 4,553,353 | 11/1985 | Simpson | 49/161 |
| 4,669,765 | 6/1987 | Ullman | 292/175 X |

FOREIGN PATENT DOCUMENTS

| | | | |
|---|---|---|---|
| 321859 | 11/1929 | United Kingdom | 292/175 |

*Primary Examiner*—James R. Brittain

*Attorney, Agent, or Firm*—Myron C. Cass

[57] ABSTRACT

A pre-assembled latch for mounting externally on the header of a pivotal sash window of a double-hung sash window assembly. The latch includes a housing having a spring-biased latch bolt normally providing a protruding bevelled formation for engaging a guide rail of the window assembly. The housing has depending spring clip means integral therewith for retaining the latch bolt operably assembled in the housing and the latch bolt has means cooperating with the housing for retaining the spring means in biasing association with the latch bolt.

5 Claims, 1 Drawing Sheet

EXTERNALLY MOUNTED LATCH FOR SLIDABLE SASH WINDOW

RELATED APPLICATION

This is a continuation-in-part application of Ser. No. 07/148,035 filed Jan. 25, 1988, now U.S. Pat. No. 4,837,975 for the invention "Externally Mounted Latch For Slidable Sash Window" and owned by a common assignee.

FIELD OF THE INVENTION

This invention relates generally to a manually operative latch for a window sash of a double-hung window assembly and more particularly, to a novel latch constructed to be supplied as an assembled operable latch ready for mounting externally on the top header of a window sash.

BACKGROUND OF THE INVENTION

A double-hung window assembly includes a window frame and a pair of window sashes reciprocal vertically in guide rails of the master frame jamb of the window assembly. Such a window sash also can be pivotally mounted in the window frame. Normal vertical movement of the window sash is maintained by latch mechanisms located at opposed corners of the window sash. Such a latch mechanism will include a latch bolt or slider which can slide along the guide rails and which, while engaged in the guide rails, prevents pivoting of the window sash. When the latch bolt is retracted from the guide rail, the window sash can be pivoted on suitably installed pivot pins which usually engage sash balance mechanisms of the assembly.

The window sash can be formed either of extruded plastic frame members or metal frame members joined at corners to form a generally rectangular frame in which the glazing is mounted. In my U.S. Pat. Nos. 4,553,353, 4,578,903 and 4,622,778 are disclosed latch mechanisms in which the latch bolt or slider is located on the interior of the header member of the sash frame and a control button is accessible externally of the header member for operating the latch. In each instance, the latch includes coil springs normally biasing the latch bolt into engagement with the opposing guide rail. It will be seen that these latches cannot be preassembled for shipment to the window manufacturer ready for installation as a complete or assembled unit with the coil spring already in place. Thus, these latches are supplied in knocked-down assembly and hence entail a labor expense factor in their installation attributable to the assembly procedure required for installation.

My U.S. Pat. No. 4,622,778 disclosed a latch for a window sash which is mounted externally on the header member of the window. However, this latch also is not capable of being supplied as an assembled unit ready for installation. The configuration of the individual parts of the latch does not provide for their assembly and shipment as a complete unit ready for installation. Consequently, this latch necessitates labor time involvement for its assembly and installation.

The latch of U.S. Pat. No. 4,622,778 also includes a "connector member" of L-Shape configuration which has a dual function, one of which is to maintain the latch bolt and coil springs in place for operation. A prior art latch for external mounting on the header member is specifically described and shown herein which does not use such a connector member. In this latch structure, there is no connector member which has a flat part to hold the coil springs and bolt in place for assembly: Consequently, in such a prior latch, the parts are shipped knocked-down and are to be assembled in situ prior to installation of the header member. Here, the coil springs and latch bolt are placed in a cap or cover member and are required to be retained in place manually by the assembler. Then, the unit must be manipulated by inversion for placement flat on the header so that the header surface can function to keep the coil springs and latch bolt in operable assembly in the cover or cap. This manipulative procedure requires speed and dexterity in order to keep the coil springs from dislodging before the latch parts can be secured to the header.

The latch embodying the invention enables the latch to be supplied to the window manufacturer as a completely assembled unit ready for installation on the header member of the window sash. The assembled unit is comprised of a housing. a latch bolt or slider and spring means. The latch bolt has means integrally formed therewith constructed and arranged to form a pocket for retaining the spring means in place in the housing. Further, the housing has spring clip means integral with and depending from the housing to cooperatively engage said bolt for preventing inadvertent separation or dislodging of the latch bolt from the housing during sliding movement of the latch bolt.

SUMMARY OF THE INVENTION

A latch for external mounting on the header member of a pivotal window sash which is provided already assembled and ready for installation. The latch is comprised of a housing, a latch bolt or slider and spring means. The latch bolt has means integrally formed therewith constructed and arranged to form a pocket for receiving and retaining the spring means in place in the housing. Further, the housing has cooperating means for preventing inadvertent separation or dislodging of the latch bolt from the housing during sliding movement of the latch bolt, said means comprising a pair of resilient fingers or clips engaging opposite edges of the latch bolt.

DESCRIPTION OF THE PREFERRED EMBODIMENT

Figure 1:
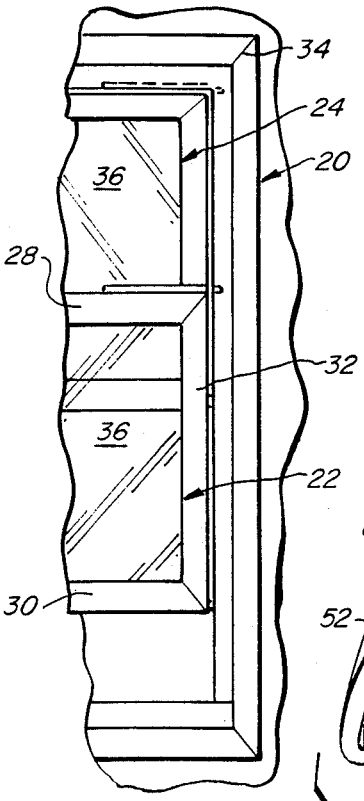
FIG. 1 is a fragmentary front elevational view of a double-hung window assembly having the latch embodying the invention on a window sash of the assembly.

FIG. 1 illustrates partially a representative window of the so-called double-hung window sash assembly. Such an assembly includes a main jamb frame 20 within which is slidably mounted a pair of double hung sashes 22 and 24 fitted with suitable glazing. Both the frame 20 and sashes 22 and 24 can be formed of several different materials, such as metal or strong and rigid plastic materials well known in this field. For purposes of this invention, the sashes 24 and 22 are pivotal relative to the frame 20 to permit cleaning and other required maintenance thereof.

The main frame 20 and the sashes 22 and 24 preferably are fabricated from elongate framing members of hollow configuration in transverse cross-section for well known reasons of weight economy and thermal insulation advantages. The exact construction of main frame 20 is not critical for achieving the advantages of this invention. The vertical structural members of the frame 20 will mount sash balances (not shown) which will cooperate with pivot pins (not shown) installed on the sashes 22 and 24 to permit desired pivotal movement of the sashes relative to the master frame. Further, these vertical structural members of the frame 20 will present guide rails facing toward a contiguous sash with which the latch mechanism embodying the invention operates. A typical guide rail is designated 26 in FIG. 2 for the purpose of describing this invention. The guide rail 26 would be formed in a side jamb 27 of the jamb frame 20.

Figure 2:
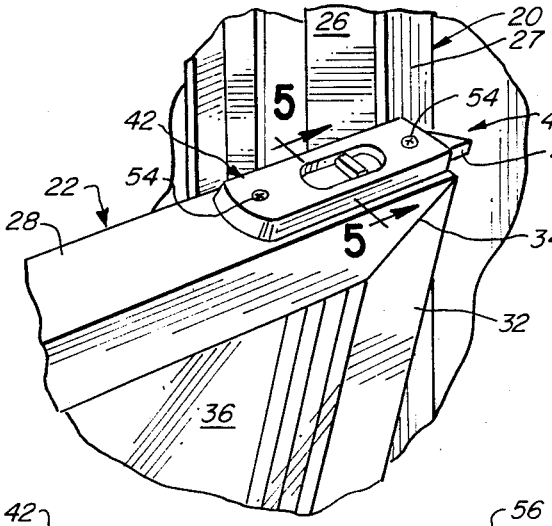
FIG. 2 is a fragmentary perspective view of a window sash in a pivoted open position and displaying the latch embodying the invention installed.

Referring to FIGS. 1 and 2, a sash 22 is generally rectilinear in configuration and is comprised of a top header 28, a base 30 and a pair of side members or stiles, one of which is illustrated at 32. The stiles or side members 32 are jointed at their extremities to contiguous extremities of the header and base members, as seen at 34, to provide the sash frame of desired size and configuration. The jointed corners of the sash are maintained by suitable fasteners and brackets of well-known commercially available types. It will be appreciated that the upper sash 24 will be of like or similar construction. The glazing 36 is conventionally installed in a sash frame.

As depicted in FIG. 13 of application Ser. No. 07/148,035, a prior art latch is illustrated and designated by the reference numeral 1. The latch 1 is provided with a housing 2, an access opening 3, a bolt 4 having a beveled latch formation at one end 5 and an ovate finger pull opening 6, as well as a pair of springs 7 secured between rectangular bolt wings 8 and spring stop members 9. During normal installation practice, the housing 2 is placed on its back as shown in said FIG. 13 and the bolt 4 and springs 7 are operationally positioned therein. To install the header 28 of a window sash 22, it will be necessary to manually hold the springs in place and rapidly invert the latch for placement flat on the sash header 28. Care must be taken so that the springs 7 and latch bolt 4 do not dislodge from the housing. This is a labor-intensive operation and time is lost in production where these parts are dislodged.

The latch embodying the herein invention is designated generally by the reference character 40 in FIG. 2. The component parts of the latch 40, as seen in exploded view of FIG. 3 include a cover or housing 42, a latch bolt 44 and a coil spring 46. The housing 42 and latch bolt 44 are plastic molded members of suitably strong synthetic resin, such as polystyrene, for instance. The latch 40 is seen installed externally on the header 28 of the sash 22 in FIG. 2 and exposed for manual operation thereof.

Figure 3:
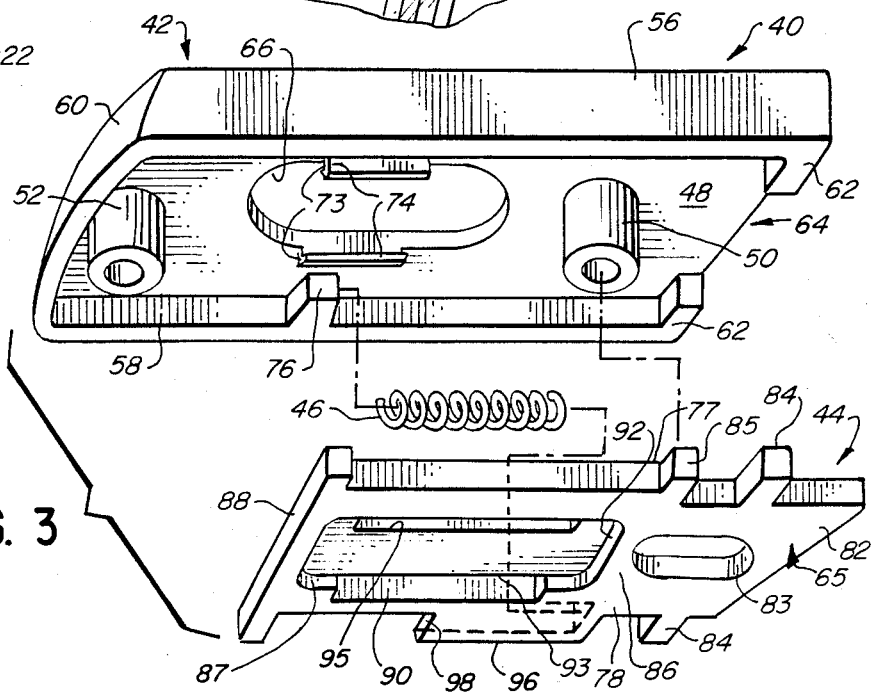
FIG. 3 is an exploded perspective view of the latch embodying the invention which is illustrated in FIG. 2.
Figure 4:
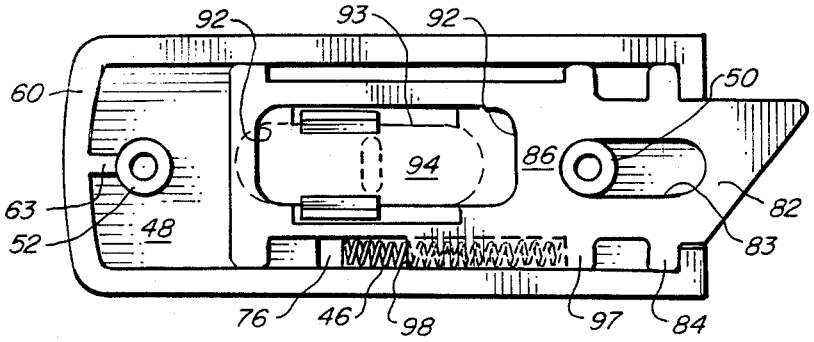
FIG. 4 is a bottom plan view of the latch illustrated in FIG. 2 but shown assembled.
Figure 5:
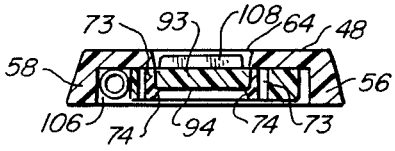
FIG. 5 is a sectional view taken through the latch along the line 5—5 of FIG. 2 and in the direction indicated generally.

Referring to FIGS. 3, 4 and 5, the housing or cover 42 is rectangular in configuration and has a planar top wall 48 having a pair of depending, spaced apart posts 50 and 52. The posts 50 and 52 each have threaded openings therethrough for accommodating a self-threading fastener 54 for fastening the latch 40 to a header 28. Depending from top wall 48 are depending side wall flanges 56 and 58 connected by a depending end wall flange 60. Each flange 56 and 58 has a right angle wall segment 62 at its free end, the segments 62 facing toward and spaced from one another to define a passageway 64 for passage of the engagement end 65 of the latch bolt 44. The post 52 is seen joined to the end wall 60 by segment 63. The post 50 is in closer proximity to the passageway 64 and opposing same on a line centered between segments 62.

Top wall 48 has an elongated oval or cartouche-like access opening 66 therein located somewhat medially in said wall 48. The circular opening 68 in top wall 48 serves to accommodate a finger piece is accessible for moving the latch bolt 44 as will be described in greater detail. Integral with and depending from opposing elongate edges of the opening 70 are the latch bolt retainer members or clips 72. The members 72 each comprises a downwardly extending resilient flange 73 having an inwardly facing edge or lip 74 so that the ledges or lips 74 face toward and are spaced from one another. The length of the flange part 73 is selected so that the ledges 74 provide a space 75 from the underside of the wall 48 sufficient to accommodate the latch bolt or slide 44 therebetween and permit the latch bolt to slide.

Integral with side wall flange 58 is short segment 74 which extends in a direction toward the opposite side wall flange 56 to serve as a spring stop member.

As seen in FIG. 3, the short metal coil spring is designated 46. The selected length for the spring 46 will be amplified.

The latch bolt 44 is an integral, planar member with particular formations provided from end-to-end thereof for achieving specific functions. The entire upper surface 77 of the latch bolt 44 is planar, smooth and uninterrupted except for certain through-slot openings from the surface 76. The latch bolt 44 also has a substantially planar lower surface 78.

Latch bolt 44 has a beveled end or latch formation 82, through which extends an ovate slot 83. Extending outwardly from opposite sides of the latch bolt are the wings 84 and 85, 97 and located between the extremities of ovate slot 83. Extending inwardly from slot 83 is a segment 86 which connects to a second elongate actuator slot 87. The opposite end of the latch bolt 44 is designated 88 which serves to close off one end of the slot 87. One longitudinal edge of slot 87 has an elongate notch 90 therein. Extending between the opposite extremities 92 of slot 87 is a narrow, flat wall 93 which is flush with the upper surface 77 of the latch bolt 44 but having its opposite surface 94 recessed from the surface 78 of the latch bolt. The wall 91 has an intermediate notch or recess 95 along one side edge thereof.

Referring to FIGS. 2 and 4, the latch bolt 44 is designed to be positioned within the cover 42 so that the latch formation 82 projects through the passageway 64, the post 50 is located within the slot 83, and the latch bolt is supported on ledges 74 in the space 75. The bolt 44 is adapted to be snap-fit into the cover 42 passed the beveled ledges 74 for reciprocal linear sliding movement therein on the upper flat surfaces of ledges 74 as illustrated in FIG. 5. The wall 93 actually rides on the ledges which are positioned in the notches or recesses 90 and 95 respectively. These notches 90 and 95 are sufficiently long to permit the required sliding movement of the latch bolt 44 between opening and closing positions thereof relative to the guide rail 26.

The latch bolt 44 has a laterally extending lip formation 96 which is flush with the lower surface 78 and extends from the short wall or wing 97 toward the extremity 92 and terminates far short thereof at an end 98. The axial length of the lip 97 is selected to be substantially less than the linear distance between wing 97 and wall segment 76. The lip 94 also is less thick than the latch bolt so as to provide a retainer overhang formation for the spring 46 as will be described. The end 98 of lip 96 is spaced from the wall segment 76 so as to provide an entrant to the space below the overhang formation.

The wall segments 97 and 76 each have an end face which on the segment 97 functions as a stop for the end 100 of the spring 46. The end 102 of the spring 46 opposite the end 100 is placed against the spring stop member 76. The spring 46 is sufficiently long so that when the bolt 44 is installed beneath the cover 42, the spring 46 exerts a biasing force which maintains the bolt 44 projecting through passageway 64.

Once installed within the cover 42, the spring 46 is located in a pocket 106 defined by the underside of the cover 42, a side edge of the bolt 44, the end face of segment 97, the spring stop 76 and the inside face of the depending side flange 58. The lip 94 is designed to prevent the escape of the spring 46 from the pocket 106 prior to the installation of the latch 30 upon the surface 28 of the sash 22, 24.

Upstanding from the upper surface 108 of the wall 93 is a short laterally extending finger piece 110. The finger piece 110 extends into the slot 87 sufficiently for access to reciprocate the latch bolt 44 as desired.

While the preferred embodiment of the invention has been disclosed, it will be understood that the invention may be otherwise embodied within the scope of the appended claims. Minor variations in the structure and in the arrangement and size of the various parts may occur to those skilled in the art without departing from the spirit and scope of the claims appended hereto.

I claim:

1. In a pivotal window sash adapted for installation in the master frame of a double-hung sash window assembly having opposed, vertically extending guide rails to enable vertical reciprocal sliding movement of the sash in the master frame while cooperatively engaged with the guide-rails, the sash having a header, a base and a pair of stiles cooperatively connected together at adjacent extremities thereof to from a rectangular sash frame; the herein invention comprising a manually operable latch adapted to be installed as a pre-assembled unit on an exterior surface of the header for releasably securing said sash to said master frame to permit pivotal movement of said sash and comprising:

a housing including a top wall having an elongated access opening therethrough, a pair of opposing end walls, one of said end walls having a passageway therethrough;

a latch bolt slidably received in said housing and having a beveled end aligned with and reciprocal in said passageway and arranged to be engaged in a guide rail for locking the window sash against pivotal movement;

spring means in said housing and engaging sad latch bolt normally to bias said beveled end into said guide rail;

said latch bolt having a laterally extending lip formation integral therewith and having a lateral free edge for overlying said spring means and retaining said spring means in operable assembly in the housing;

said top wall having integrally formed means for engaging and retaining the latch bolt in operable assembly in the housing and permit reciprocal sliding movement thereof, comprising a pair of spring-like clip formations depending from said top wall along opposing longitudinal edges of said access opening to engage said latch bolt along opposing longitudinal edges thereof, said latch bolt having an upstanding actuator member integral with a surface of said latch bolt and slidable in said access opening for manually moving the latch bolt.

2. The latch of claim 1 wherein said lip formation is spaced from the top wall to define a pocket for said spring means, said pocket having an opening thereinto at one end thereof through which the spring means can be installed in the pocket.

3. The latch of claim 2 wherein said housing has means for installing the pre-assembled unit on said header surface comprising at least one post depending from the underside of said top wall having a bore therethrough for accepting a threaded fastener therethrough into said header for retaining the latch secured on the header.

4. A latch adapted to be pre-assembled ready for mounting as a unit on the top header of a pivotal sash window slidable in parallel guide rails of the master jamb of a double-hung sash window assembly, said latch comprising:

(a) a housing having a top wall and depending opposing end walls, one of said end walls having a passageway therethrough communicating to exterior of the housing;

(b) a latch bolt slidably mounted in the housing and having a bevelled end reciprocal in said passageway and engageable with a guide rail to prevent pivotal movement of the sash window;

(c) a spring member engaged with the latch bolt normally biasing said bevelled end into engagement with the guide rail;

(d) said latch bolt having an integral, lateral extending lip with a lateral free edge spaced from the top wall to form a pocket having the spring member retaining in the pocket against inadvertent dislodgement therefrom;

(e) resilient retainer means integral with and supported from said top wall for engaging and retaining the latch bolt operably assembled within the housing comprising, a pair of spring clip formations each having a ledge formation at its free extremity;

(f) said latch bolt having an intermediate wall segment, said wall segment having opposite edges thereof engaging said spring clip formations and slidably supported on said ledge formations;

(g) said top wall having an access opening therethrough having said clip formations depending therefrom along opposing longitudinal edges of said access opening to engage said latch bolt for sliding movement on said ledge formations and said latch bolt having upstanding manually operable means slidable in said opening for reciprocating the latch bolt.

5. The latch as described in claim 4 including said spring clip formations depending from said top wall along opposing lateral edges of the access opening.

* * * * *

UNITED STATES PATENT AND TRADEMARK OFFICE

CERTIFICATE OF CORRECTION

PATENT NO. : 4,901,475

DATED : February 20, 1990

INVENTOR(S) : Harold Simpson

It is certified that error appears in the above-identified patent and that said Letters Patent is hereby corrected as shown below:

Claim 1, line 62; "sad" should be --said--.

Claim 4, line 42; "lateral" should be --laterally--.

Claim 4, line 45; "retaining" should be --retained--.

Signed and Sealed this

Fourth Day of December, 1990

*Attest:*

HARRY F. MANBECK, JR.

*Attesting Officer*

*Commissioner of Patents and Trademarks*